United States Patent [19]

Arao

[11] Patent Number: 5,007,387

[45] Date of Patent: Apr. 16, 1991

[54] FOUR VALVE PER CYLINDER ENGINE HEAD

[76] Inventor: Masachika Arao, 21400 Lassen St., Unit G, Chatsworth, Calif. 91311

[21] Appl. No.: 471,366

[22] Filed: Jan. 29, 1990

[51] Int. Cl.[5] ..... F01L 1/18; F02P 15/02

[52] U.S. Cl. ..... 123/90.022; 123/310; 123/315; 123/432

[58] Field of Search ..... 123/90.22, 90.23, 90.39, 123/90.40, 193 H, 310, 315, 308, 432

[56] References Cited

U.S. PATENT DOCUMENTS

| | | | |
|---|---|---|---|
| 1,907,663 | 5/1933 | Pope, Jr. | 123/310 X |
| 2,700,966 | 2/1955 | Hofer | 123/90.4 |
| 2,863,429 | 12/1958 | Bouteleux | 123/90.22 |
| 2,884,913 | 5/1959 | Heintz | 123/275 |
| 3,884,199 | 5/1975 | Irimajiri et al. | 123/90.22 |
| 4,023,543 | 5/1977 | Ishikawa | 123/90.22 X |
| 4,520,775 | 6/1985 | Nakamura | 123/315 X |
| 4,660,529 | 4/1987 | Yoshikawa | 123/315 X |
| 4,819,591 | 4/1989 | Valentine | 123/90.22 |
| 4,905,646 | 3/1990 | Tanahashi | 123/315 X |

FOREIGN PATENT DOCUMENTS

| | | | |
|---|---|---|---|
| 0589642 | 6/1947 | United Kingdom | 123/315 |

*Primary Examiner*—Willis R. Wolfe
*Attorney, Agent, or Firm*—Albert O. Cota

[57] ABSTRACT

An improved head assembly for an internal combustion gasoline engine having an internal camshaft and push rod system which has a head (20) adapted to utilize four valves per cylinder using push rods (50) without modification to the engine block. The exhaust valves (36) are positioned longitudinally parallel with each cylinder and the inlet valves 38 are at a 10 to 18 degree angle from the engine cylinder centerline. The push rods (50) are so positioned as to allow contact with rocker arms (40) lifting the valves in sequence.

4 Claims, 2 Drawing Sheets

FOUR VALVE PER CYLINDER ENGINE HEAD

TECHNICAL FIELD

The present invention relates to heads for gasoline internal combustion engines in general, and more specifically to head conversions having four valves per cylinder with the spark plug centered between the valves and push rods communicating directly with rocker arms actuating the valves.

BACKGROUND ART

Previously, many attempts have been made in engine modifications replacing the head with a retrofit that utilizes the existing camshaft driving pushrods, rocker arms and four valves which are arranged in the classic "V" form of the intake and exhaust valves. In the past, a heavy and costly relay rocket system has been employed for this purpose as the normal pushrod location is very close to the cylinders creating mechanical complexity or unwieldness. Another approach, equally unwieldly has been tried employing particularly long rocker arms, however, bending deflections render this design rather impractical. Both the German Audi V-8 and the Volkswagon Rabbit engines have a combustion chamber, exhaust and intake valve grouping and inclination angle, that is similar in configuration with the invention, however, they use direct acting overhead camshafts on each set of valves. This approach is simpler and efficient only when incorporated as an initial design, as engines already in service are not able to be modified by the simple replacement of a high performance head as in the present invention because the cost of two to four camshafts and their drive system must also be included.

A search of the prior art did not disclose any patents that read directly on the claims of the instant invention, however, the following U.S. patents were considered related:

| PAT. NO. | INVENTOR | ISSUED |
|---|---|---|
| 4,819,591 | Valentine | 11 April 1989 |
| 4,023,543 | Ishikawa | 17 May 1977 |
| 3,884,199 | Irimajiri et al | 20 May 1975 |
| 2,884,913 | Heintz | 5 May 1959 |
| 2,863,429 | Bouteleux | 9 December 1958 |
| 2,700,966 | Hofer | 1 February 1955 |

Valentine teaches a plurality of poppet valves positioned by their stems which are not all parallel. A rocker is mounted such that a rocking axis is produced transverse to each stem axis and the tappet elements are not on the same plane through the rocker axis. Each valve has an intermediate lift travel and the rocker axis is in line with the point of engagement with the tappet having the end face of the valve stem perpendicular to the valve stem axis.

Ishikawa discloses an auxiliary valve preventing any communication to the cylinder until the auxiliary valve has been lifted beyond a predetermined point.

Irimajiri et al utilize a valve operating system having main and auxiliary rocket arms for operating valves, each having a common upper tappet, push rod and lower cam operated tappet connected by a ball and socket joint. A similar cam operated assembly is provided for the exhaust valve which also employs a rocker arm for actuation.

Heintz teaches an internal combustion engine with the spark plug positioned between the intake and exhaust valve.

Hofer uses one rocker arm pivoted on either side of the cylinder head with a pivoted lever linkage arranged across the cylinder head opposite the camshaft with two inlet and two outlet valves disclosed.

For background purposes and as indicative of the art to which the invention relates, reference may be made to the remaining cited patent.

DISCLOSURE OF THE INVENTION

Existing engines produced domestically, particularly the V6 and V8 configuration, employ two valves per cylinder which has been dictated by economy. While this approach is basically acceptable, there are some inefficiencies, such as restricted flow areas through valve ports which limit power at high engine speeds. Further, the position of the spark plug is not in the optimum location which should be in the center of the combustion chamber and the shape of the combustion chamber is governed by the two valve design not resulting in the lowest possible exhaust emissions and highest combustion efficiency.

It is, therefore, a primary object of the invention to employ a unique conversion head utilizing four valves with the spark plug in the center with the push rods and rocker arms so positioned as to locate the exhaust valves in a near parallel position relative to the cylinder. This combination creates a near optimum configuration of the combustion chamber and allows the exhaust and intake valves to have an angular displacement between 12 to 15 degrees with no change required in the remainder of the engine.

An important object of the invention is the novel approach to the valve arrangement replacing the heretofore utilized relay rocker arm head employing an additional rocker arm and undesirably long push rods placed in series with the existing standard arrangement to actuate the exhaust valves. With this arrangement, the intake and exhaust valves are in the classic "V" position, as viewed from the flywheel, creating a "pentroof" type combustion chamber.

The present invention modifies this combustion chamber shape in such a manner that this relay system or long rocker arms is substituted with the higher efficiency short rocker arms. This design accomplishes the desired use of greater flow yielding four valves at angles allowing the spark plug location and combustion chamber configuration to be advantageous and highly superior to the prior art.

Another object of the invention leads to higher engine speeds and greater power due to the shortness of the rocker arms.

Still another object of the invention increases performance with less emissions as the combustion chambers configuration is conducive for charge combustion and therefore the fuel is efficiently consumed. Further, the head is simpler to produce with less parts used, therefore, reliability and maintainability are increased.

Yet another object of the invention is an additional feature that may be added in the form of a second spark plug positioned in the side of the head at approximately 45 degrees between the exhaust valve seats. This additional spark plug is used for competitive racing when nitrated fuels are utilized furthering the utility of the invention.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
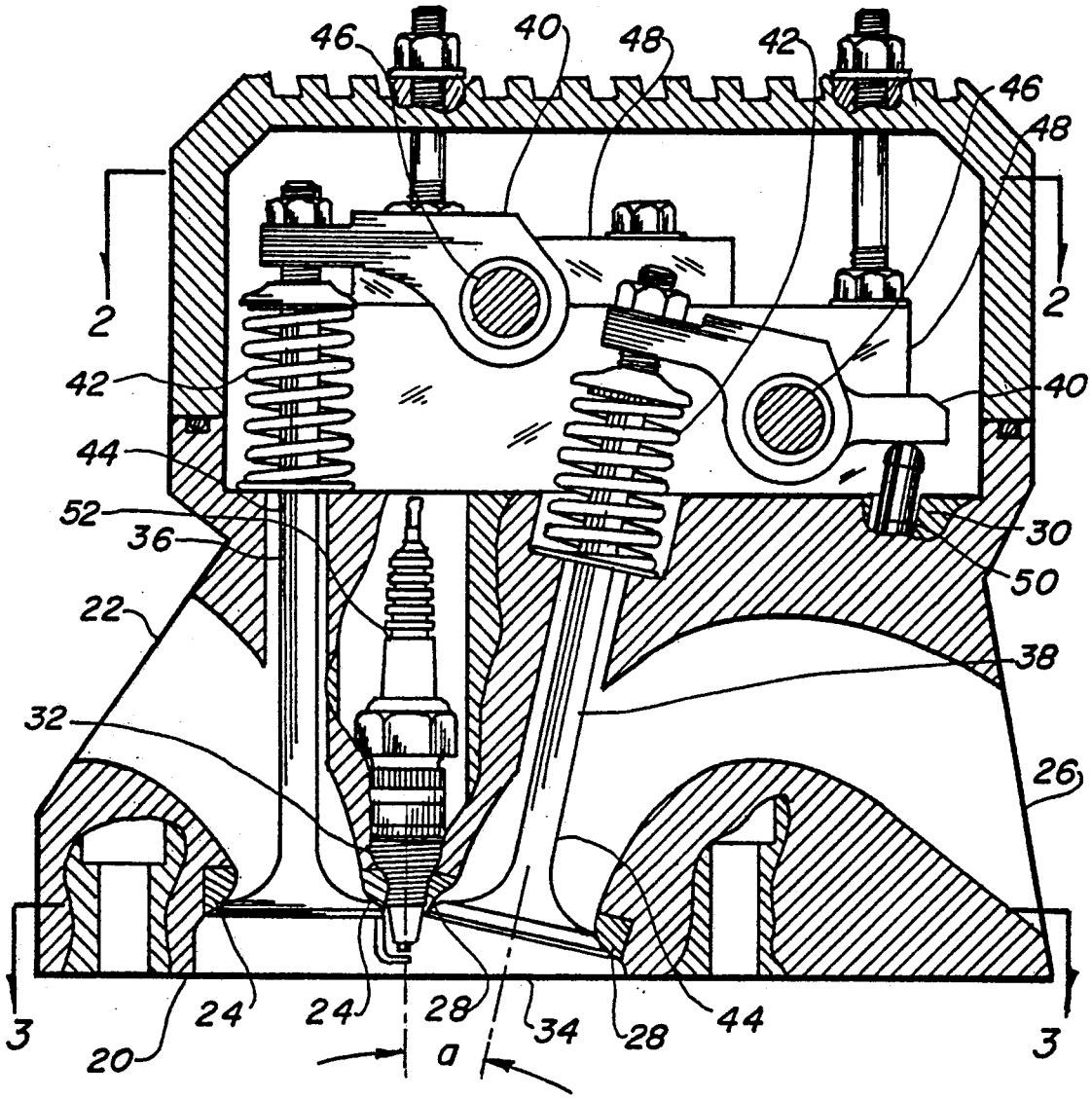
FIG. 1 is a cross-sectional view of the head taken along a typical valve arrangement illustrating the valves, spark plug, rocker arm, rocker arm shafts and push rods. It will be noted that this view is representative of all of the components as they are identical within each cylinder interface.

The best mode for carrying out the invention is presented in terms of a preferred embodiment and is illustrated in FIGS. 1 through 4. The invention is limited to a head assembly 20 for a gasoline engine having an internal cam shaft and push rod system, such as a V-6 or V-8. The particular engines with which this head positions best, is an American made General Motors, Ford or Chrysler product and, as such, is ideal for conversions. As an example, the drawings depict a small block Chevrolet V-8, 1988 model engine conversion head. The head 20 has a pair of exhaust valve ports 22 with seats 24 and a pair of intake valve ports 26 also with seats 28. The seats are alternatively formed with bushings, as depicted in FIG. 1. In any event, one pair is provided for each cylinder defining the four valve system.

The head 20 further contains a plurality of push rod passages 30 in linear alignment with the engine camshaft (not shown) one passage 30 for each pair of valves. Further, a threaded hole 32 for the spark plug is centrally located between the valves in the general area around the ports 22 and 26 with the hole 32 recessed and the area thereunder forming a combustion chamber 34.

Figure 4:
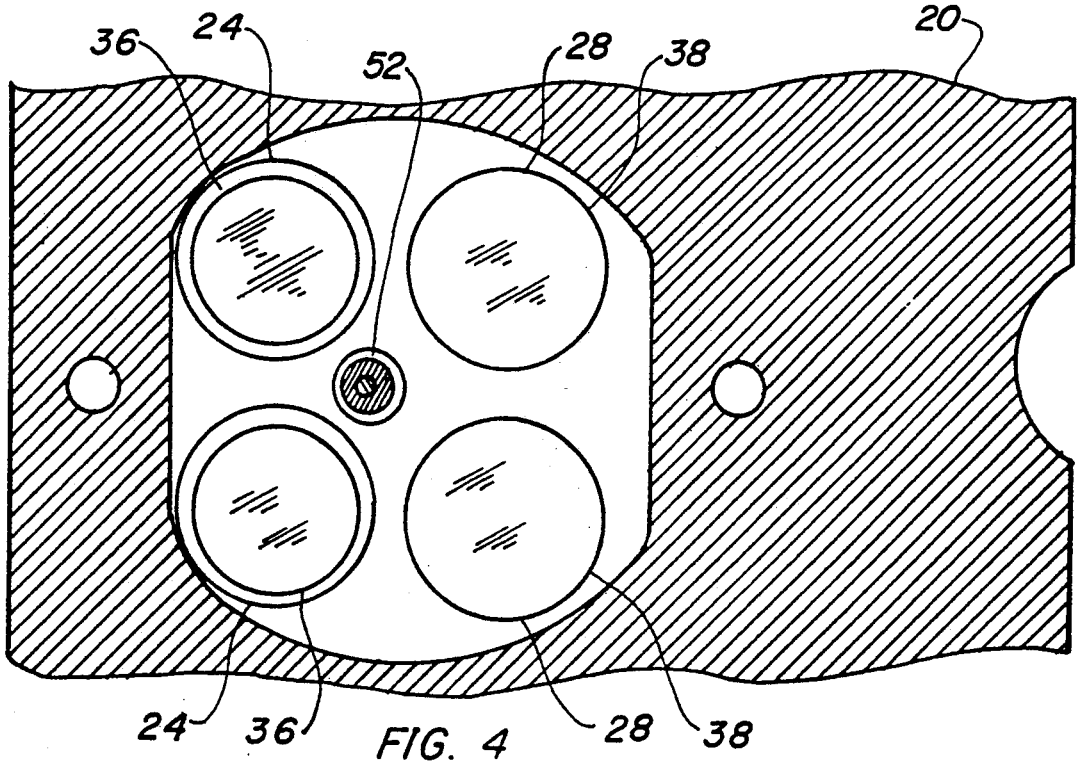
FIG. 4 is a cross-sectional view taken along lines 3—3 of FIG. 1 at the valve seat depicting the valve and spark plug arrangement as they enter the combustion chamber. For clarity the chamber is illustrated circular, although technically in cross-section it is actually below in some areas and the intake valve takes on an elliptical shape.

A pair of exhaust valves 36 are disposed longitudinally parallel and almost laterally parallel at least within plus or minus 2 degrees with each cylinder centerline in the engine and are contiguous with the exhaust valve port 22 and seat 24. FIGS. 1 and 4 illustrate this positioning relationship which is important to the invention in that it allows all of the valves to be in close proximity and optimally position the spark plug in the center therebetween.

Figure 3:
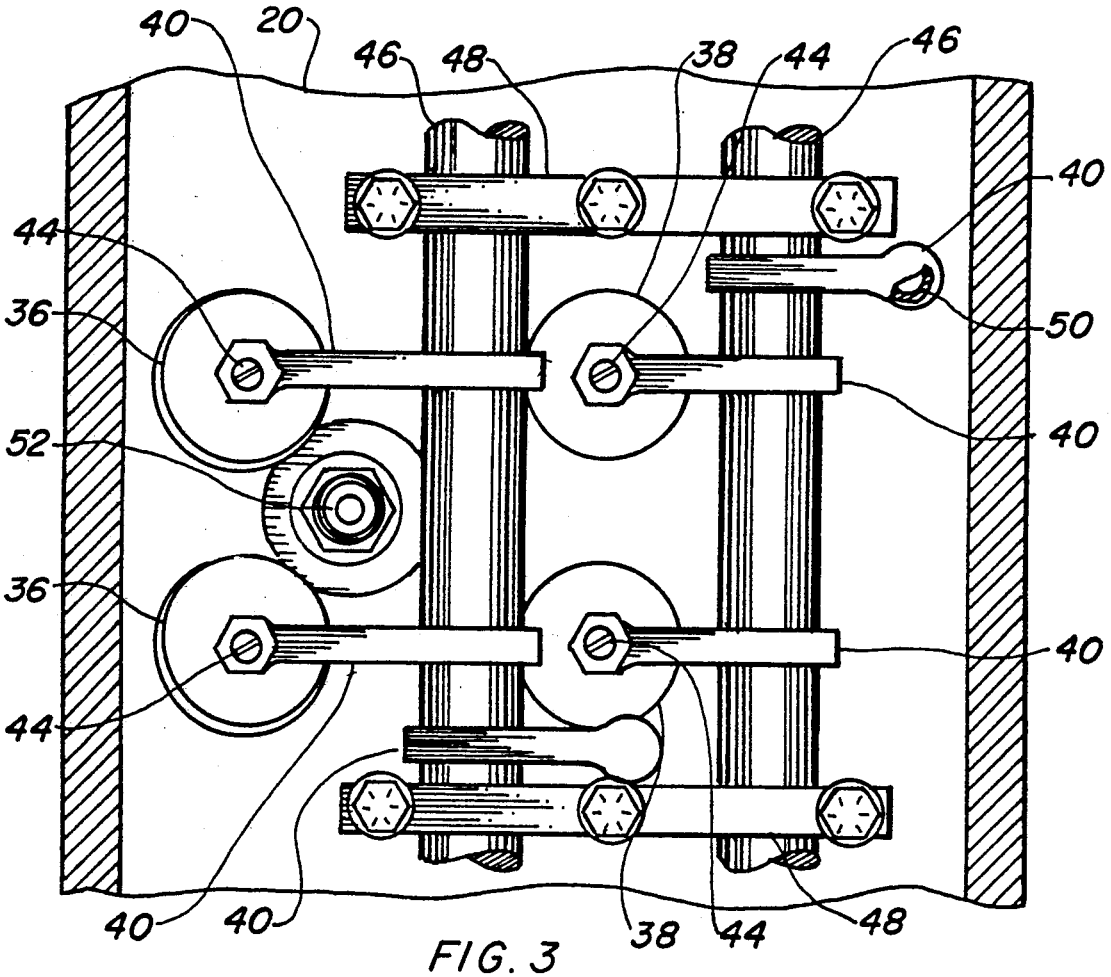
FIG. 3 is a cross-sectional view taken along lines 2—2 of FIG. 1 just below the inside of the valve cover illustrating in plan view the valve and rocker arm arrangement.

A pair of equal length inlet valves 38 are disposed angularly with respect to each cylinder in the engine and are contiguous with the intake port 26 and seat 28 again, FIGS. 1 and 3 depict this configuration. The angularity is obviously kept to a minimum, however, it has been found that an angle "a", as shown in FIG. 1, of 10 to 18 degrees is acceptable, with 12–15 degrees preferred.

A plurality of rocker arms 40, with valve springs 42, are each attached to the stem 44 of the exhaust and inlet valves 36 and 38 for lifting and returning the valve to the seat 24 and 28 in the head 20. The springs 42 assist in returning the valves to the closed position and the pressure of combustion forces the valve into a tight relationship with the seat sealing the ports 22 and 26.

A pair of rocker arm shafts 46 retain the rocker arms 40, one for each set of related exhaust valves 36, and the other for the inlet valves 38. The shafts are held in place by brackets 48 that position and retain the rocker arms at their appropriate location.

A number of push rods 50 are positioned in the passages 30, as shown pictorially in FIG. 1 and are in alignment with a rocker arm 40 such that each pair of valves are lifted from the head 20 in sequence producing a timed cyclic action allowing function of the reciprocating engine.

It will be noted that the positioning of the valves 36 and 38 along with the spark plug 52 in the hole 32 is critical to the invention and is part of the novelty, along with the ability to utilize the remainder of the engine without modification.

Figure 2:
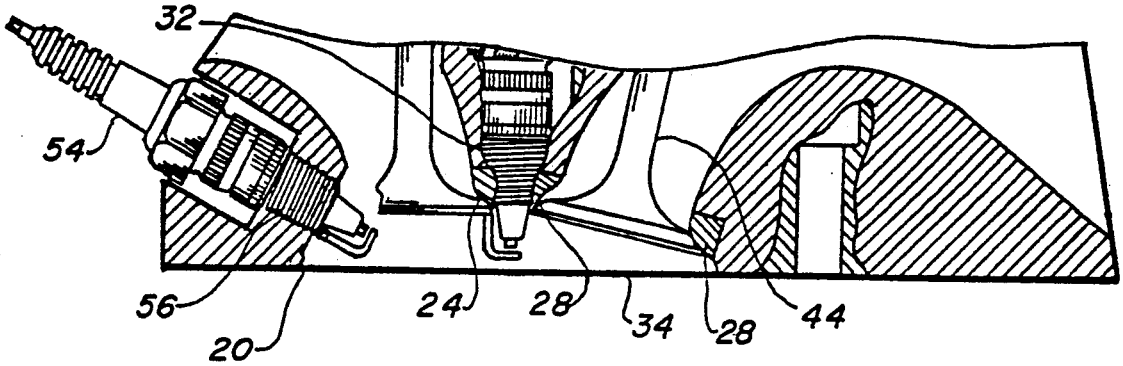
FIG. 2 is a fragmentary view taken in the same cross-section as FIG. 1 depicting the addition of an auxiliary spark plug in a variation of the preferred embodiment.

A supplementary feature may be added to the preferred embodiment in the form of an auxiliary spark plug 54 that is located in the head between two exhaust valve seats 24 as illustrated in FIG. 2. This spark plug 54 is positioned in a mating threaded hole 56 at an angle of from 40 to 50 degrees relative to the head and engine interface with 45 degrees being preferred. The spark plug 54 provides efficient combustion for nitrated fuels commonly used in racing competition and allows further flexibility of the head assembly 20.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

What is claimed is:

1. An improved head assembly for an internal combustion gasoline engine having an integral camshaft and push rod system comprising:

a head having a pair of exhaust valve ports with seats and a pair of intake valve ports with seats for each cylinder, also a plurality of push rod passages in linear alignment with the engine camshaft, and a threaded spark plug hole centrally located between the ports, the general area around the ports with the threaded hole recessed with the areas underneath and between the engine forming a combustion chamber, a pair of exhaust valves disposed longitudinally parallel and having angularity with each cylinder centerline in said engine and contiguous with the appropriate port for relieving the combustion gases on an exhaust stroke, a pair of inlet valves disposed angularly with respect to each cylinder in said engine contiguous with the appropriate port for introducing a combustible mixture of fuel and air into the engine on a suction stroke, a plurality of rocker arms and valve springs, the arms contacting said valves and the springs surrounding the valve stem for lifting the valves and returning them into contact with the valve seats under the influence of the springs at the appropriate timing, a pair of rocker arm shafts unitedly retaining the rocker arms in rotatable linear containment allowing each set of valves to react in sequence for operation of the engine, a plurality of push rods drivingly communicating between the engine camshaft and said rocker arms such that each pair of valves are lifted from the head in a sequence producing a cyclic action allowing the engine to operate, and an auxiliary spark plug threadably disposed within the head between the two exhaust valve seats to provide efficient combustion required by nitrated fuels utilized in vehicle racing competition.

2. An improved head assembly for an internal combustion gasoline engine having an integral camshaft and push rod system comprising:

a head having a pair of exhaust valve ports with seats and a pair of intake valve ports with seats for each cylinder, also a plurality of push rod passages in linear alignment with the engine camshaft, and a threaded spark plug hole centrally located between the ports, the general area around the ports with the threaded hole recessed with the areas underneath and between the engine forming a combustion chamber, a pair of exhaust valves disposed longitudinally parallel and having angularity with each cylinder centerline in said engine and contiguous with the appropriate port for relieving the combustion gases on an exhaust stroke, a pair of inlet valves disposed angularly with respect to each cylinder in said engine contiguous with the appropriate port for introducing a combustible mixture of fuel and air into the engine on a suction stroke, a plurality of rocker arms and valve springs, the arms contacting said valves and the springs surrounding the valve stem for lifting the valves and returning them into contact with the valve seats under the influence of the springs at the appropriate timing, a pair of rocker arm shafts unitedly retaining the rocker arms in rotatable linear containment allowing each set of valves to react in sequence for operation of the engine, a pluraity of push rods drivingly communicating between the engine camshaft and said rocker arms such that each pair of valves are lifted from the head in a sequence producing a cyclic action allowing the engine to operate, and an auxiliary spark plug threadably disposed within the head between the two exhaust valve seats at an angle from 40 degrees to 50 degrees relative to the head and engine interface to provide efficient combustion required by nitrated fuels utilized in vehicle racing competition.

3. An improved head assembly for an internal combustion gasoline engine having an integral camshaft and push rod system comprising:

a head having a pair of exhaust valve ports with seats and a pair of intake valve ports with seats for each cylinder, also a plurality of push rod passages in linear alignment with the engine camshaft, and a threaded spark plug hole centrally located between the ports, the general area around the ports with the threaded hole recessed with the areas underneath and between the engine forming a combustion chamber, a pair of exhaust valves disposed longitudinally parallel and having angularity from minus 2 to plus 2 degrees relative to said engine cylinder centerline in said engine and contiguous with the appropriate port for relieving the combustion gases on an exhaust stroke, a pair of inlet valves disposed angularly with respect to each cylinder in said engine contiguous with the appropriate port for introducing a combustible mixture of fuel and air into the engine on a suction stroke, a plurality of rocker arms and valve springs, the arms contacting said valves and the springs surrounding the valve stem for lifting the valves and returning them into contact with the valve seats under the influence of the springs at the appropriate timing, a pair of rocker arm shafts unitedly retaining the rocker arms in rotatable linear containment allowing each set of valves to react in sequence for operation of the engine, and a plurality of push rods drivingly communicating between the engine camshaft and said rocker arms such that each pair of valves are lifted from the head in a sequence producing a cyclic action allowing the engine to operate.

4. The head assembly for an internal combustion engine as recited in claim 3 wherein said head combustion chamber is a pentroof type and the exhaust and inlet valves are in a "V" position.

* * * * *